US007748471B2

(12) United States Patent
Osadchuk et al.

(10) Patent No.: US 7,748,471 B2
(45) Date of Patent: Jul. 6, 2010

(54) MOBILE SELF-ERECTING DIRECTIONAL DRILLING RIG APPARATUS

(75) Inventors: Mark Osadchuk, Scottsdale, AZ (US); John Heieie, Maricopa, AZ (US)

(73) Assignee: Southeast Directional Drilling, LLC, Casa Grande, AZ (US)

( * ) Notice: Subject to any disclaimer, the term of this patent is extended or adjusted under 35 U.S.C. 154(b) by 6 days.

(21) Appl. No.: 11/774,365

(22) Filed: Jul. 6, 2007

(65) Prior Publication Data

US 2009/0008110 A1 Jan. 8, 2009

(51) Int. Cl.
*E21B 7/02* (2006.01)
*E21B 15/04* (2006.01)

(52) U.S. Cl. ..... 173/28

(58) Field of Classification Search ..... 173/1, 173/28

See application file for complete search history.

(56) References Cited

U.S. PATENT DOCUMENTS 3,942,593 A * 3/1976 Reeve et al. ..... 173/186
4,036,508 A * 7/1977 Eddy et al. ..... 280/492
4,223,870 A * 9/1980 Bartholomew ..... 254/334
4,249,600 A * 2/1981 Bailey ..... 166/77.2
4,258,796 A * 3/1981 Horning et al. ..... 175/52
4,269,395 A * 5/1981 Newman et al. ..... 254/386
4,290,495 A * 9/1981 Elliston ..... 175/85
4,336,840 A * 6/1982 Bailey ..... 166/77.4
4,347,692 A * 9/1982 Culver ..... 52/117
4,407,629 A * 10/1983 Willis ..... 414/745.2
4,637,475 A * 1/1987 England et al. ..... 173/193
4,703,812 A * 11/1987 Johnson ..... 173/152
4,938,296 A * 7/1990 Brazell, II ..... 173/185
5,018,588 A * 5/1991 Haberer ..... 173/185
5,074,366 A * 12/1991 Karlsson et al. ..... 175/76
5,213,169 A * 5/1993 Heller ..... 175/122
5,921,329 A * 7/1999 Armstrong ..... 175/57
6,609,565 B1 * 8/2003 Andreychuk et al. ..... 166/77.2
7,111,689 B2 * 9/2006 Wise et al. ..... 166/384

OTHER PUBLICATIONS

American Augers, Inc.; DD-330; Maxi Directional Drill Operation and Safety Instruction Manual; Mar. 2002, pp. 1-81; West Salem, OH USA.

* cited by examiner

*Primary Examiner*—Brian D Nash
(74) *Attorney, Agent, or Firm*—Honigman Miller Schwartz and Cohn LLP

(57) ABSTRACT

An apparatus and method for horizontal drilling are provided. The apparatus has: (A) a thrust frame; (B) a carriage on the thrust frame; (C) a wheel truck, wherein a rearward portion of the thrust frame can be supported in a lowered position on the wheel truck; (D) a king pin for operatively connecting a forward portion of the thrust frame to a tractor; (E) a trailer-leg assembly that can be connected operatively between: (i) the forward portion of the thrust frame; and (ii) the ground; and wherein the trailer-leg assembly is capable of assisting in supporting the forward portion of the thrust frame: (a) in a raised position so a tractor can be connected for towing; and (b) in a lowered position where the forward portion of the thrust frame is in a lowered position adjacent the ground to assist in positioning the thrust frame in a position for drilling.

35 Claims, 8 Drawing Sheets

MOBILE SELF-ERECTING DIRECTIONAL DRILLING RIG APPARATUS

CROSS-REFERENCE TO RELATED APPLICATIONS STATEMENT REGARDING FEDERALLY SPONSORED RESEARCH OR DEVELOPMENT

Not applicable.

REFERENCE TO MICROFICHE APPENDIX

Not applicable

FIELD OF THE INVENTION

This invention generally relates to horizontal drilling rigs. More specifically, the invention relates to apparatuses and methods for horizontal drilling.

SUMMARY OF THE INVENTION

The invention provides an apparatus for horizontal drilling. The apparatus has (A) a thrust frame; (B) a carriage having a spindle (or rotator) for drilling operations, wherein the carriage is positioned to move forward and backward along the thrust frame; (C) a wheel truck, wherein a rearward portion of the thrust frame can be supported in a lowered position on the wheel truck; (D) a king pin for operatively connecting a forward portion of the thrust frame to a tractor; (E) a trailer-leg assembly that can be connected operatively between: (i) the forward portion of the thrust frame; and (ii) the ground adjacent to the forward portion of the thrust frame; and wherein the trailer-leg assembly is capable of assisting in supporting the forward portion of the thrust frame: (a) in a raised position off the ground so that a connector (e.g., a fifth wheel) of a tractor can be moved into or out of position under the forward portion of the thrust frame, whereby the tractor can be removed from or connected to the forward portion of the thrust frame for towing; and (b) in a lowered position where the forward portion of the thrust frame is in a lowered position adjacent the ground, whereby the forward portion of the thrust frame can be lowered to assist positioning the thrust frame in an inclined position for horizontal drilling operations.

Preferably, the trailer-leg assembly is removable from the thrust frame.

According to a further aspect, the apparatus includes a jack assembly that can be connected operatively between: (i) a rearward portion of the thrust frame; and (ii) the ground adjacent the rearward portion of the thrust frame; wherein the jack assembly is capable of assisting in lifting or lowering the rearward portion of the thrust frame between: (a) a lowered position where the rearward portion of the thrust frame is in a lowered position supported on the wheel truck; and (b) a raised position where the rearward portion of the thrust frame is in a raised position that is higher than the lowered position. Still more preferably, the apparatus also includes a bracing assembly, wherein the bracing assembly comprises: (A) a rearward leg sub-assembly that can be connected operatively and selectively between: (i) the rearward portion of the thrust frame; and (ii) the ground adjacent to the rearward portion of the thrust frame, wherein the rearward leg sub-assembly is capable of assisting in supporting the rearward portion of the thrust frame in the raised position; and (B) a strut sub-assembly that can be connected operatively and selectively between: (i) a forward portion of the thrust frame; and (ii) a lower portion of the rearward leg sub-assembly; whereby, when the rearward portion of the thrust frame is the raised position, the thrust frame, the rearward leg sub-assembly, and the strut sub-assembly can be set and locked into a rigid, substantially triangular structural arrangement to stabilize the apparatus for drilling operations.

According to another aspect of the invention, a method for assisting in erecting a horizontal drilling rig is provided. The method includes the steps of: (A) towing a horizontal drilling rig comprising: (a) a thrust frame; (b) a carriage having a spindle for horizontal drilling operations, wherein the carriage is positioned to move forward and backward along the thrust frame; (c) a connector on the thrust frame for operatively connecting the thrust frame to a tractor; and (d) a wheel truck, wherein a rearward portion of the thrust frame can be supported in a lowered position on the wheel truck; (B) jacking up the forward portion of the thrust frame with a trailer-leg assembly and disconnecting the tractor from the thrust frame; (C) lowering the forward portion of the thrust frame adjacent to the ground; and (D) removing the trailer-leg assembly from blocking the movement of the carriage forward and backward along the thrust frame.

More preferably, the method further includes the step of: jacking upward the rearward portion of the thrust frame to a raised position relative to the lowered position. Still more preferably, the method further comprising the step of: bracing the rearward portion of the thrust frame in the raised position.

Other and further objects, features, and advantages of the present invention will be readily apparent to those skilled in the art when the following description of the preferred embodiments is read in conjunction with the accompanying drawings.

BRIEF DESCRIPTION OF THE DRAWING

The accompanying drawing is incorporated into and forms a part of the specification to illustrate an example of the present inventions. The drawing together with the description serves to explain the inventions. The drawing is only for illustrating a preferred and alternative example of how the inventions can be made and used and is not to be construed as limiting the inventions to the illustrated and described example. Advantages of the present inventions will be apparent from a consideration of the drawing in which.

DESCRIPTION OF A PRESENTLY MOST-PREFERRED EMBODIMENT

Figure 2:
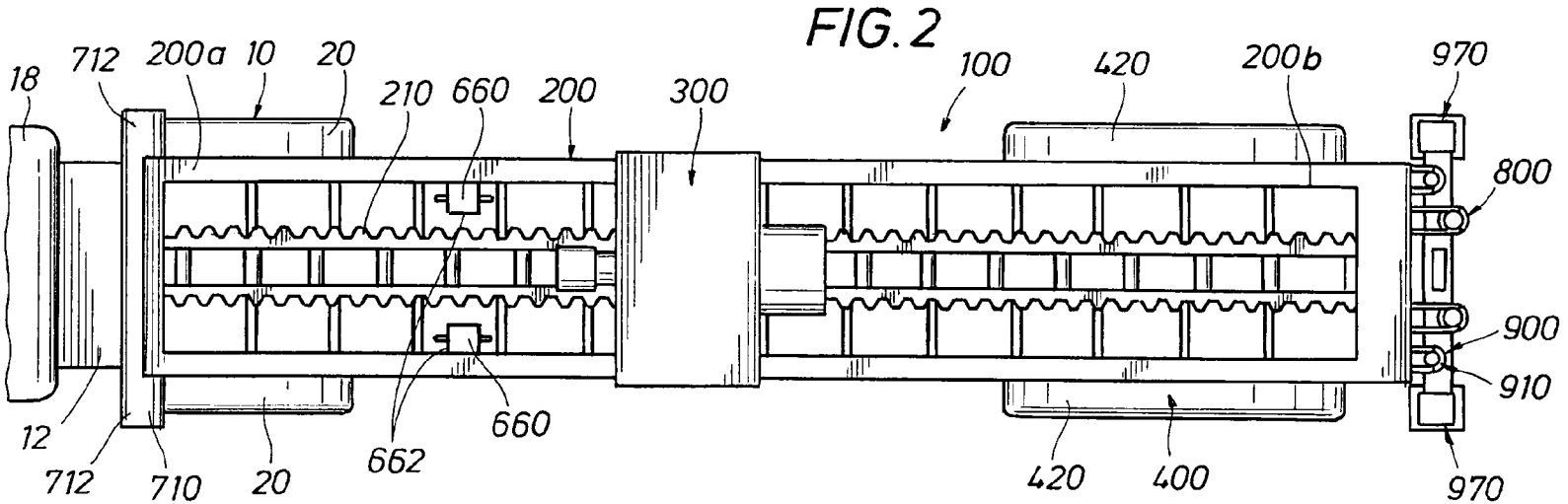
FIG. 2 is a top view of the mobile directional drilling rig apparatus shown in FIG. 1.

As used herein, the words "comprise," "has," and "include" and all grammatical variations thereof are each intended to have an open, non-limiting meaning that does not exclude additional elements or steps.

Also, as used herein, words such as "attached" or "connected" mean and include the concept of attachment through one or more other and intermediate structures, that is, a direct attachment or connection between structural elements is not necessarily required. Further, it should be appreciated that "operatively connected" means according to the principles of mechanical attachment as described and shown in the various figures of the drawing and variations thereof, as will be appreciated by those of skill in the art.

Apparatus in General

Figure 1:
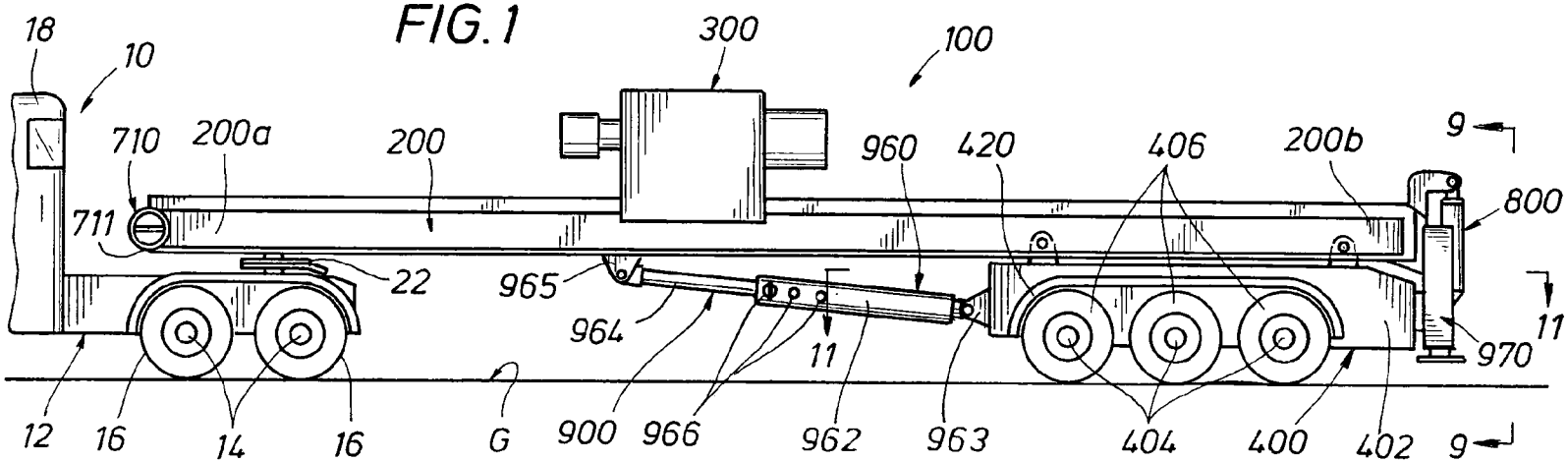
FIG. 1 is a side view of a mobile directional drilling rig apparatus according to a presently preferred embodiment of the inventions, wherein the thrust frame of the drilling rig is in a substantially horizontal position, as shown: (a) supported at a forward portion by the fifth wheel of a tractor, and (b) supported at a rearward portion by a wheel truck.

Referring first to FIGS. 1-2 of the drawing, FIG. 1 is a side view of a towing vehicle, such as a road tractor 10 (partially shown), operatively connected for towing a mobile directional drilling rig apparatus 100 according to a presently preferred embodiment of the invention. FIG. 2 is a top view of the tractor 10 and mobile directional drilling rig apparatus 100 shown in FIG. 1.

In general, as used herein, words describing relative orientation or position, such as "forward," "backward," "side," "left," "right," "upper," "lower," "bottom," and similar terms regarding various elements in the views of the drawing are with respect to the perspective of a hypothetical person sitting forward in the driver's seat of the towing tractor 10 when connected to the apparatus 100 as shown in FIGS. 1-2.

As used herein with reference to a position relative to a horizontal plane relative to the ground G, "substantially" means within an angle of about plus or minus 15 degrees to a horizontal plane.

Road Tractor

The road tractor 10 is a type of towing vehicle having a chassis 12, usually three axles, such as axels 14, a plurality of wheels, such as wheels 16, an engine and drive train (not shown), and a cab 18 (partially shown) for a driver (not shown). The wheels 16 are commonly covered by a fender 20 that surrounds the upper portions of wheels 16 to block splashing water and mud. The tractor 10 preferably has a wide coupling plate known as a fifth wheel coupling 22 bolted onto the rearward end of its chassis 12 on which a forward end of a semi-trailer can rest and pivot. A fifth wheel coupling 22 can provide a link between a semi-trailer and the towing truck, tractor unit, leading trailer, or dolly.

The Drilling Rig Apparatus as a Semi-Trailer

Referring again to FIGS. 1-2, the apparatus 100 includes a thrust frame 200, a carriage 300 having a spindle 310 (sometimes known as a rotator) for drilling operations, wherein the carriage 300 is positioned to move forward and backward along the thrust frame 200; a wheel truck 400, wherein a rearward portion **200*b* of the thrust frame 200 can be supported in a lowered position on the wheel truck 400; a king pin connector 500 (best shown in FIGS. 3-4) for operatively connecting a forward portion 200*a* of the thrust frame 200 to a tractor 10**.

Figure 6:
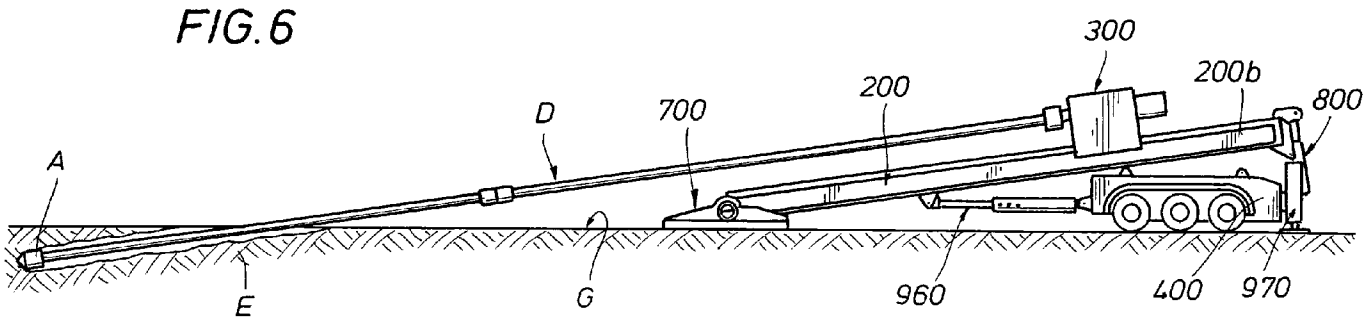
FIG. 6 is a side view of the mobile directional drilling rig apparatus shown as shown in FIG. 5, except with the trailer-leg assembly having been removed from the forward portion of the thrust frame and showing the drilling rig in the process of drilling a horizontal bore.

Referring to FIG. 1, the thrust frame 200 provides a track 210 for the carriage 300. Referring briefly ahead to FIG. 6, the carriage 300 imparts thrust and pull-back force, and rotary motion, to a drill string D. Referring back to FIGS. 1-2, the thrust frame 200 also serves or assists in serving the function of a frame for a semi-trailer.

Referring primarily to FIG. 2, the wheel truck 400 supports the rearward portion **200*b* of the thrust frame 200 during transport. The wheel truck 400 includes a frame assembly 402 (not shown in detail), which typically comprises two or more frame members and one or more cross members, and two or more axle assemblies with axles 404. The wheel truck 400 also includes a plurality of wheels 406. For example, according to a presently most-preferred embodiment, the wheel truck 400 includes three axles 404 with a pair of wheels 406 on each end of each axle, for a total of twelve wheels 406. The wheels help support the weight of the thrust frame 200 and carriage 300. The wheels 406 are commonly covered by a fender 420 that surrounds the upper portions of wheels 406 to block splashing water and mud. A plurality of connectors for attaching and securing the rearward portion 200*b* of the thrust frame 200 are connected operatively to the frame 402 of the wheel truck 400**.

Figure 4:
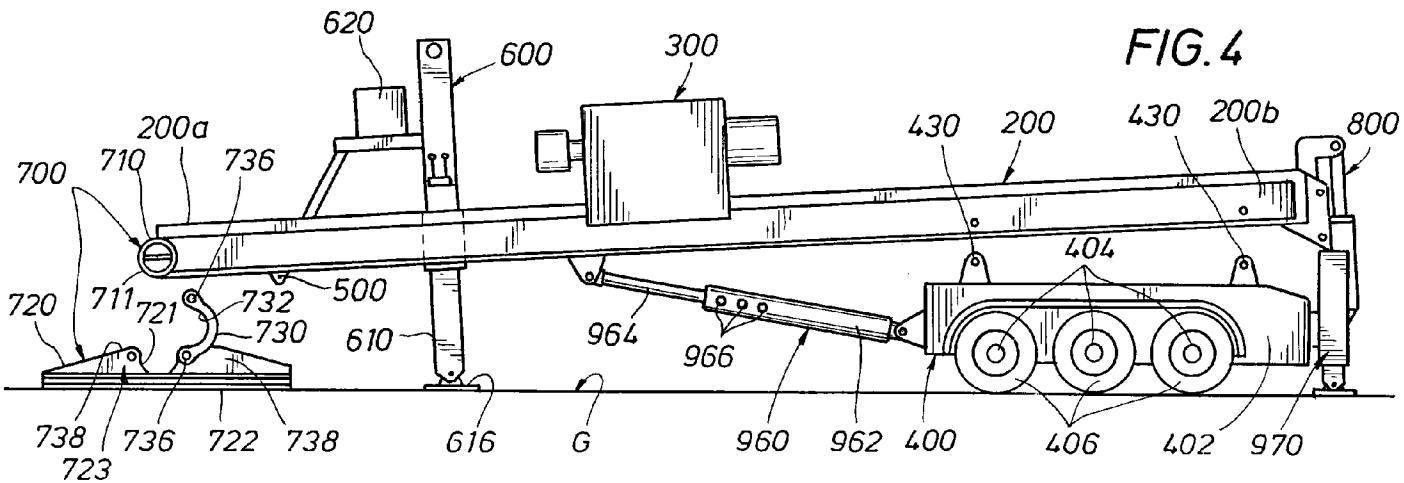
FIG. 4 is a side view of the mobile directional drilling rig apparatus shown: (a) as the trailer-leg assembly is in the process of lowering the forward portion of the thrust frame downward toward the forward pad, and (b) as the rearward jack is in the process of raising the rearward portion of the thrust frame upward for positioning of the thrust frame toward a drilling position, although it should be understood that the forward and rearward jacks would normally be operated one at a time.
Figure 11:
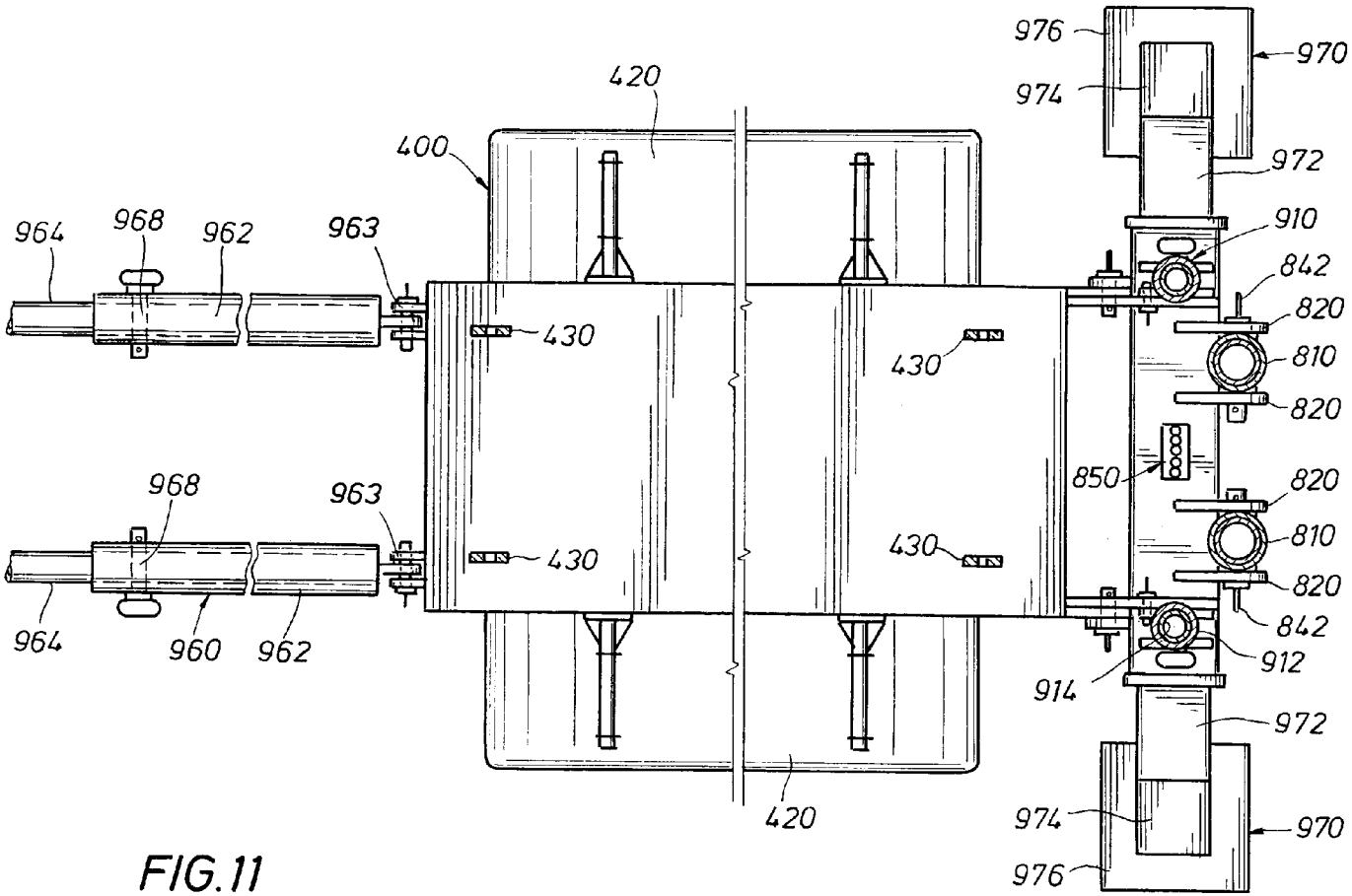
FIG. 11 is a view taken along the lines 11-11 of FIG. 1 showing the top of the wheel truck for carrying the rearward portion of the thrust frame.

As best shown in FIG. 4 and FIG. 11, according to a preferred embodiment of the invention, for example, these connectors can be in the form of ears 430 adapted for selectively attaching the rearward portion **200*b* of the thrust frame 200 to be supported for transport on the wheel truck 400, and by way of further example, by means of a pinned connection, similar to other connections employed in the preferred embodiment of the apparatus 100**.

Figure 3:
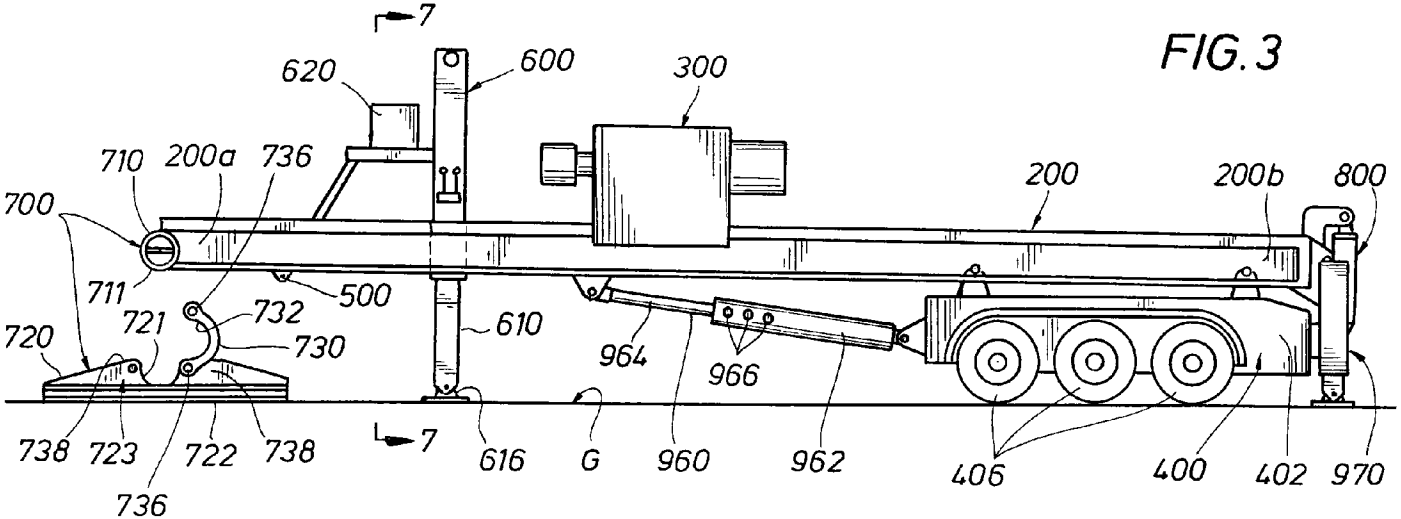
FIG. 3 is a side view of the mobile directional drilling rig apparatus shown: (a) with a trailer-leg assembly, which can be removable, positioned at the forward portion of the thrust frame and having lifted the forward portion of the thrust frame to a raised position so that the thrust frame could be disconnected from the tractor and with a forward pad positioned under the forward portion of the thrust frame ready to receive and support the forward portion of the thrust frame; and (b) with the thrust frame supported at a rearward portion by the wheel truck.

Referring briefly to FIGS. 1-3, a nipple or king pin 500 at the underside of a forward end of a semi-trailer connects to the fifth-wheel coupling 22. The structure and operation of a fifth-wheel connection between a king pin 500 and a fifth-wheel coupling 22 are conventional and well known in the art of semi-trailers. As the tractor 10 reverses under the forward end of the semi-trailer, the king pin 500 on the underside of a forward portion 200*a* of the thrust frame 200 slides into a slot in the skidplate and the jaws of the coupling 22 (not shown in detail) to close on to it.

Figure 5:
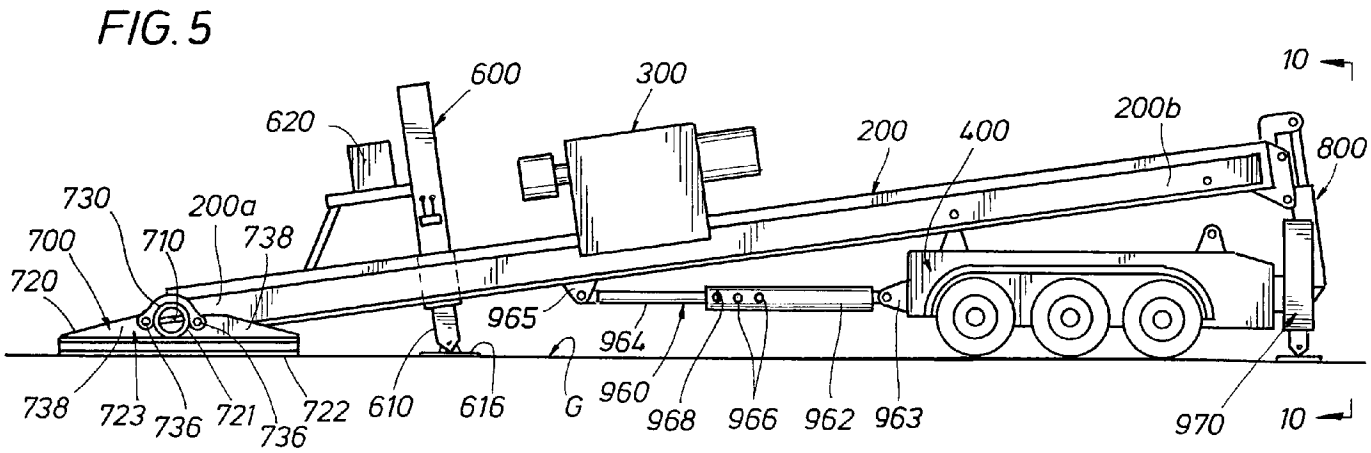
FIG. 5 is a side view of the mobile directional drilling rig apparatus shown: (a) with the trailer-leg assembly having lowered the forward portion of the thrust frame onto the forward pad, and (b) with the rearward jack having raised the rearward portion of the thrust frame to a raised position and with the rearward portion of the thrust frame rigidly supported in a raised position.

Referring briefly to FIGS. 3-5, according to one aspect of the inventions, the apparatus 100 further includes a trailer-leg assembly 600 that can be connected operatively between: (i) the forward portion 200*a* of the thrust frame; and (ii) the ground G adjacent to the forward portion 200*a* of the thrust frame. Preferably, the trailer-leg assembly 600 is removable from the thrust frame 200, and, accordingly, it is not shown in FIGS. 1-2. In addition, the apparatus 100 preferably further comprises a tie-down assembly 700 at a forward portion 200*a* of the thrust frame 200.

Accordingly, the thrust frame 200, wheel truck 400, king pin 500, and trailer leg assemblies 600 form a semi-trailer for moving the horizontal drilling rig apparatus 100. A semi-trailer is a trailer without a front axle. The semi-trailer can be coupled and uncoupled quickly. In the event of a breakdown, a tractor can be exchanged quickly and the drilling rig delivered to its destination without undue delay. It is also possible to use a dolly to tow a semi-trailer behind a rigid truck, or behind another semi-trailer. Special tractors (known as tugs or yard trucks) can be used for example, in maneuvering semi-trailers in an equipment yard. Compared with a full trailer, a semi-trailer attached to a tractor unit is easier to reverse, since it has only one turning point (the coupling), whereas a full trailer has two turning points (the coupling and the drawbar attachment). Compared with a rigid vehicle, a semi-trailer truck has a turning circle smaller than its overall length making it more maneuverable. Of course, one of the main advantages of the present inventions, as is described in detail herein, is that the trailer-leg assembly 600 can be removed, at least out of the way of the movement of the carriage 300 on the thrust frame 200, and preferably completely removed from the thrust frame.

Rear Jack Assembly and Bracing Assembly

Referring again to FIGS. 1-2, according to another aspect of the inventions, the apparatus 100 further includes a jack assembly 800 that can be connected operatively between: (i) a rearward portion 200*b* of the thrust frame 200; and (ii) the ground G adjacent the rearward portion 200*b* of the thrust frame 200. The jack assembly 800 is capable of assisting in lifting or lowering the rearward portion 200*b* of the thrust frame 200 between: (a) a lowered position where the rearward portion 200*b* of the thrust frame 200 is in a lowered position supported on the wheel truck 400 (as shown in FIGS. 1-3); and (b) a raised position where the rearward portion 200*b* of the thrust frame 200 is in a raised position that is higher than the lowered position (as shown in FIGS. 4-6).

More preferably, the apparatus 100 further includes a bracing assembly 900, wherein the bracing assembly (partially shown in FIGS. 1-2) comprises: (A) a rearward leg sub-assembly 910 that can be connected operatively and selectively between: (i) the rearward portion of the thrust frame 200*b*; (ii) the ground G adjacent to the rearward portion 200*b* of the thrust frame, wherein the rearward leg sub-assembly 910 is capable of assisting in supporting the rearward portion of the thrust frame in the raised position; and (B) a strut sub-assembly 960 that can be connected operatively and selectively between: (i) a forward portion of the thrust frame 200*a*, preferably on the underside thereof; and (ii) a lower portion of the rearward leg sub-assembly when the strut sub-assembly 910 is at least partially bracing between the forward portion of the thrust frame and the lower potion of the rearward leg sub-assembly when in the raised position. Thus, the thrust frame 200, the rearward leg sub-assembly 910, and the strut sub-assembly 960 can be set and locked into a rigid, substantially triangular structural arrangement to stabilize the apparatus for drilling operations, as illustrated in FIG. 6. The frame 402 of the wheel truck 400 is preferably between the lower portion of the rearward leg sub-assembly 910 and the strut sub-assembly 960, so that the frame 402 forms part of the substantially triangular, rigid bracing structural arrangement as shown in FIGS. 4-6.

General Method of Erecting Drilling Rig Apparatus

Accordingly, a method for assisting in transporting and erecting the apparatus 100 is provided. The method includes the steps of: (A) as illustrated in FIGS. 1-2, towing a horizontal drilling rig apparatus 100 comprising: (a) a thrust frame 200; (b) a carriage 300 having a spindle 310 for horizontal drilling operations, wherein the carriage 300 is positioned to move forward and backward along the thrust frame 200; (c) a king pin connector 500 on the thrust frame 200 for operatively connecting the thrust frame to a fifth wheel of a tractor; and (d) a wheel truck 400, wherein a rearward portion 200*b* of the thrust frame 200 can be supported in a lowered position on the wheel truck; (B) as illustrated in FIG. 3, jacking up the forward portion 200*a* of the thrust frame with a trailer-leg assembly 600 and disconnecting the tractor 10 from the thrust frame 200; (C) as illustrated in FIGS. 4-5, lowering the forward portion 200*a* of the thrust frame 200 adjacent to the ground G; and (D) removing the trailer-leg assembly 600 from blocking the movement of the carriage 300 forward and backward along the thrust frame 200, where FIG. 6 illustrates the drilling apparatus 100 after the trailer-leg assembly having been removed from the apparatus 100.

FIG. 6 further illustrates the apparatus having a drill string D having an auger A (or other type of drilling bit) at the forward end thereof attached to the spindle 310 of the carriage 300 during drilling into the earth E. Drill pipe for the drill string D is specially designed pipe threaded on both ends that conducts thrust and pull-back forces, and carries drilling fluid ("mud") to the cutting head or auger A. A cutting head or auger A can be bladed or toothed, and may have a metal shoe or hard metal teeth to remove soil. The cutting head or auger A makes a bore ready for positioning pipe or cable, without the need for back filling and compacting.

A conventional drilling mud system (not shown) for the apparatus 100 is normally transported separately from the apparatus. A conventional hydraulic power plant (not shown) for the carriage 300 of the apparatus 100 is also normally transported separately from the apparatus.

Figure 9:
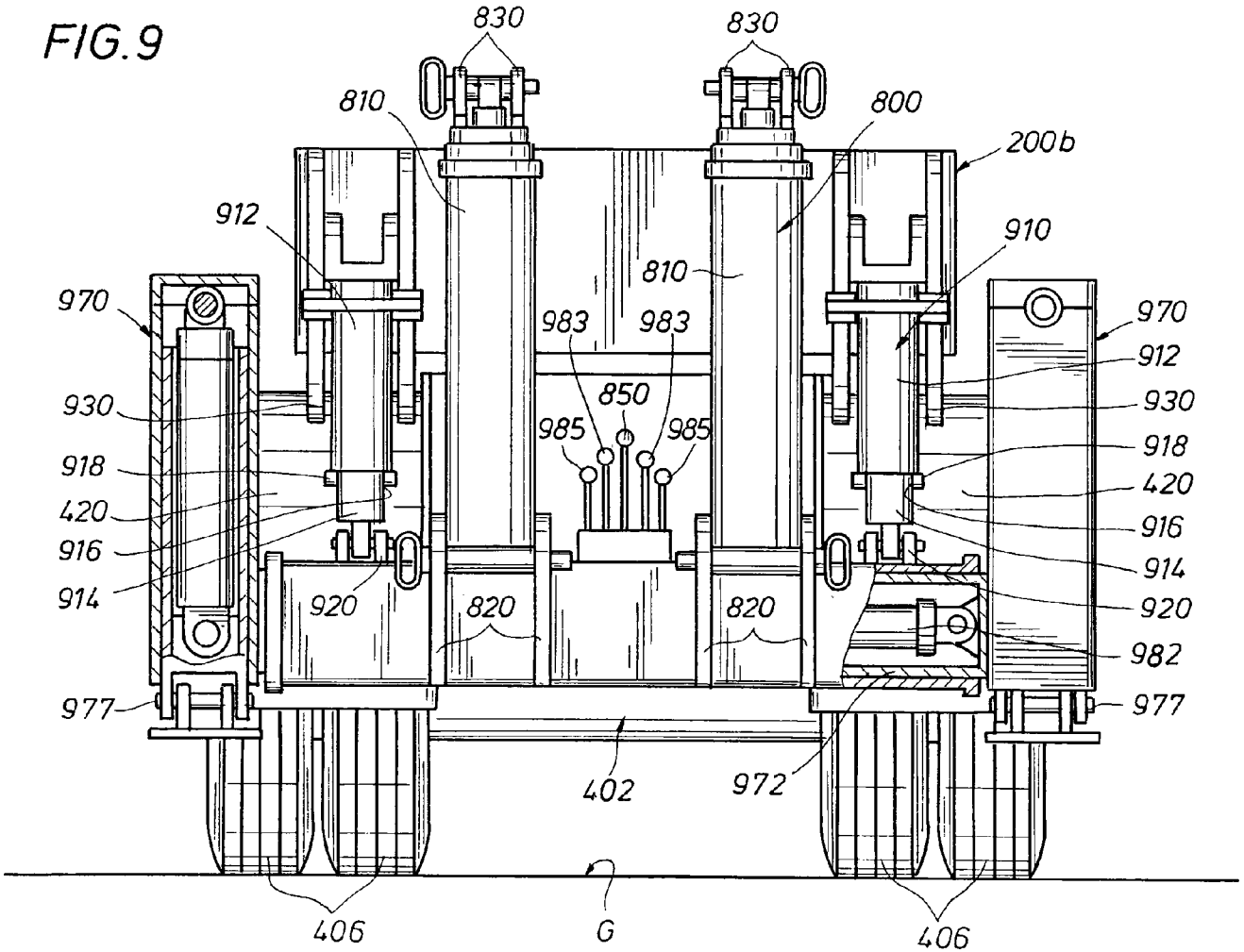
FIG. 9 is a rear view taken along the lines 9-9 of the mobile directional drilling rig apparatus shown in FIG. 1, with a partial cut-away view of the left-side vertical leg of the left-side outrigger and with a partial cut-away view of the right-side horizontally extendable arm of the right-side outrigger.
Figure 10:
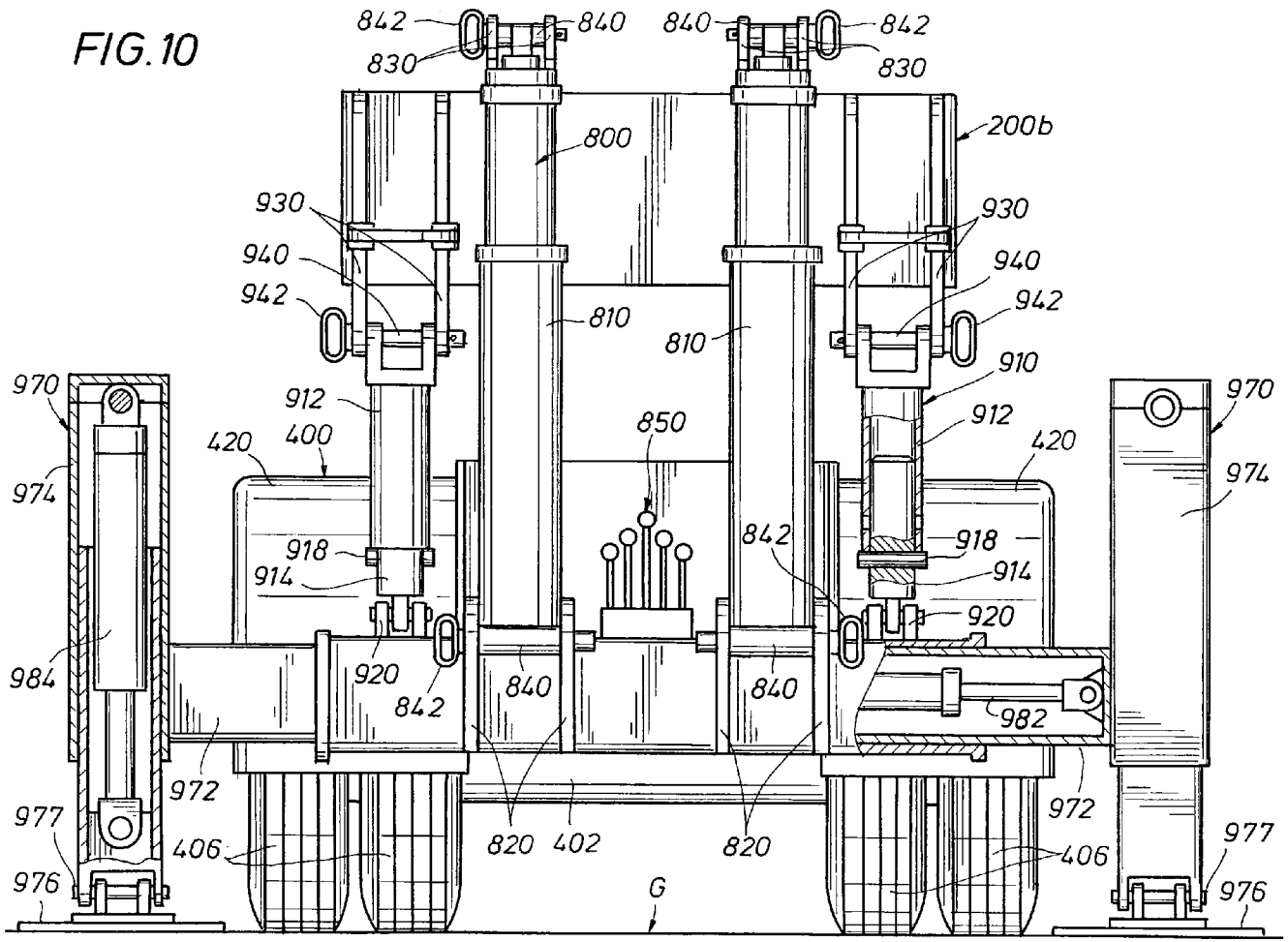
FIG. 10 is a rear view taken along the lines 10-10 of the mobile directional drilling rig apparatus shown in FIG. 5 with a partial cut-away view of the left-side vertical leg of the left-side outrigger, with a partial cut-away view of the right-side horizontally extendable arm of the right-side outrigger, and with an additional partial cut-away view of the right-side telescoping vertical rearward leg sub-assembly and as shown in the position of FIG. 5 and FIG. 6.

More preferably, as shown in FIGS. 3-5, the method further includes the step of: jacking the rearward portion 200*b* of the thrust frame upward to a raised position relative to the lowered position. Still more preferably, as shown in FIGS. 9-10, the method further includes the step of: bracing the rearward portion 200*b* of the thrust frame in the raised position.

Details of a Preferred Embodiment for a Trailer-Leg Assembly

The trailer-leg assembly 600 is capable of assisting in supporting the forward portion 200*a* of the thrust frame 200: (a) as shown in FIG. 3 in a raised position off the ground G so that a fifth wheel of a tractor can be moved into or out of position under the forward portion 200*a* of the thrust frame, whereby the tractor can be removed from or connected to the forward portion of the thrust frame 200 for towing the thrust frame; and (b) as shown in FIG. 5 in a lowered position where the forward portion 200*a* of the thrust frame 200 is in a lowered position adjacent the ground G, whereby the forward portion 200*a* of the thrust frame can be lowered to assist positioning the thrust frame 200 in an inclined position for horizontal drilling operations.

Figure 7:
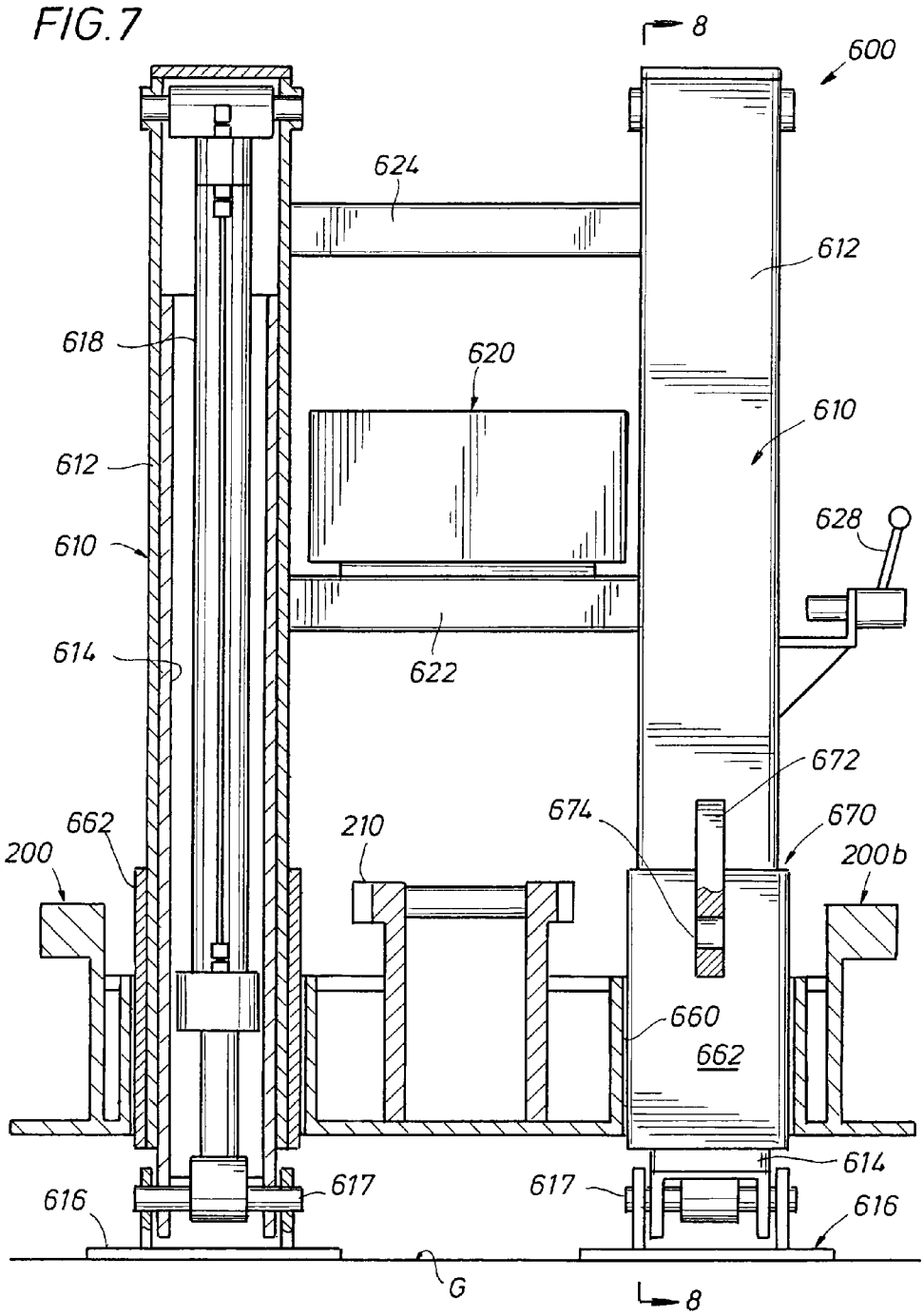
FIG. 7 is a cross-sectional view taken along the lines 7-7 of FIG. 3, including a partial cut-away view of the left-side leg of the trailer-leg assembly showing a hydraulic cylinder therein.
Figure 8:
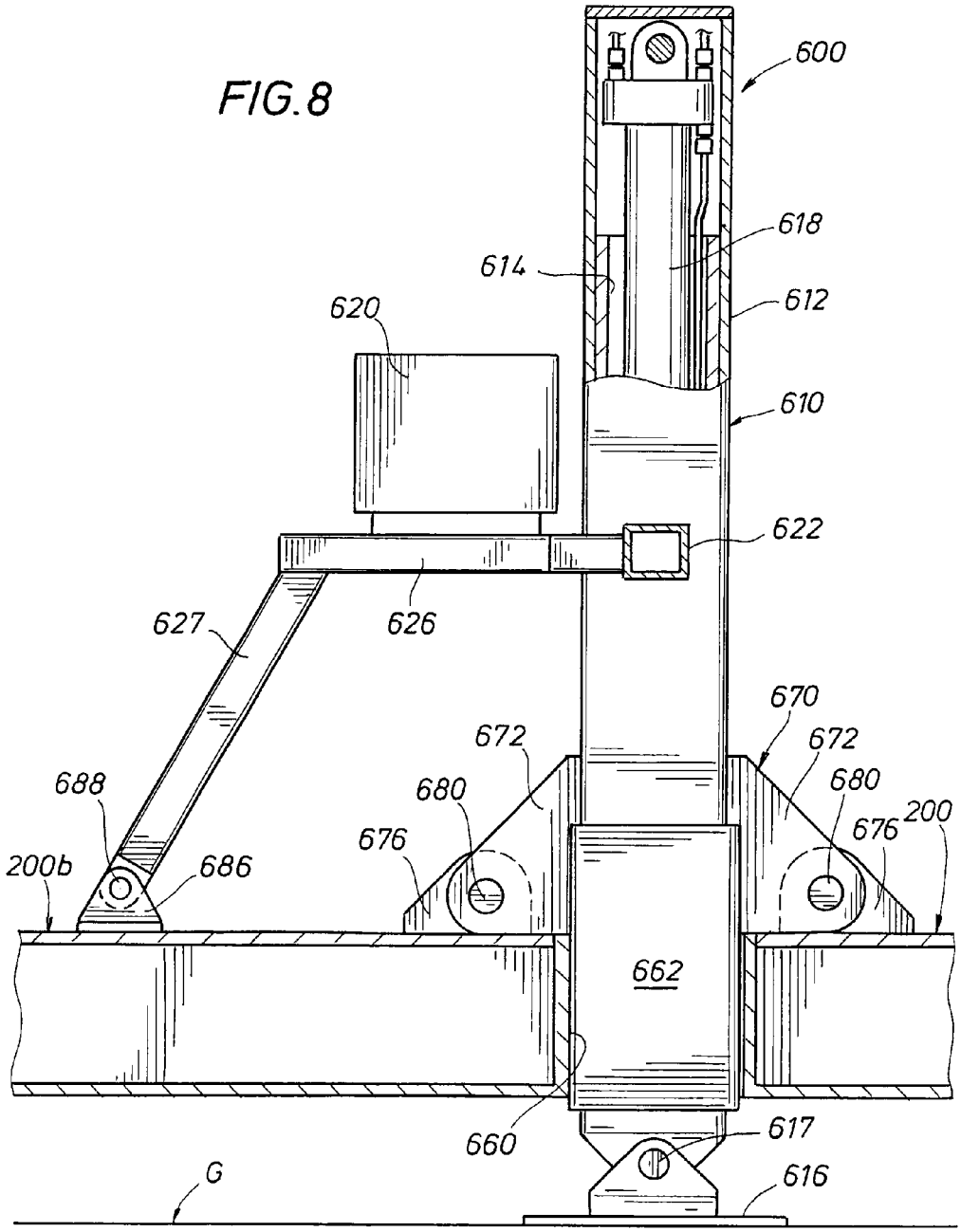
FIG. 8 is a cross-sectional view taken along the lines 8-8 of FIG. 7, including a partial cut-away view of a leg of the trailer-leg assembly.

Referring now to FIGS. 7-8, the trailer-leg assembly 600 preferably has a pair of telescoping trailer-leg sub-assemblies 610. Each of the telescoping trailer-leg sub-assemblies 610 includes a square tubular outer leg 612 and a square tubular inner leg 614 adapted to slide lengthwise or axially within the outer leg 612. It should be understood, of course, that the square-tubular shape for the telescoping trailer-leg sub-assemblies 610 is presently believed to be preferable to help position them and to prevent relative twisting of the outer legs 612 and inner legs 614, but not required. Each of the telescoping trailer-leg sub-assemblies 610 preferably includes a sand shoe 616 for landing the lower end of the leg sub-assemblies 610 onto the ground G. Each sand shoe 616 is preferably connected to the lower end of inner leg 614 at a pivotal connection 617.

Preferably, the apparatus 100 further includes a jack for the trailer-leg assembly, whereby the apparatus 100 can be connected to or removed from a tractor without a separate machine for lifting or lowering the forward portion of the thrust frame. More preferably, the jack is a hydraulic cylinder 618. Preferably, a hydraulic cylinder 618 is positioned operatively inside and between the outer leg 612 and inner leg 614 of each of the telescoping trailer-leg sub-assemblies 610. More preferably, the apparatus 100 further includes a hydraulic motor 620 for the jack for the trailer-leg assembly 600. As will be appreciated by those of skill in the art, the hydraulic motor 620 is connected operably to the hydraulic cylinders 618. The hydraulic motor 620 preferably is self-contained and advantageously provides the necessary driving force for jacking the forward portion 200*b* of the thrust frame without need for an external source of power. It is to be understood, of course, that the jack does not have to be hydraulic but could be of another type, such as a screw jack.

Preferably, the trailer-leg assembly 600, the hydraulic cylinder 618, and the hydraulic motor 620 is an assembly that can be removed selectively from and connected to the forward portion 200*b* of the thrust frame. For example, the pair of telescoping leg sub-assemblies 610 is preferably connected by a rigid lower cross-strut 622 and an upper cross-strut 624, as shown in FIG. 7. As best shown in FIG. 8, the hydraulic motor 620 is supported, for example, on a shelf 626 connected to the pair of trailer-leg sub-assemblies 610. The shelf 626 also preferably has an additional brace 627. The hydraulic motor 620 is connected operatively via hydraulic lines (not shown) to each of the hydraulic cylinders 618 in each of the pair of telescoping leg sub-assemblies 610. A hydraulic controller 628 also is provided and connected operably to the hydraulic motor 620.

Referring back briefly to FIG. 1, the pair of trailer-leg sub-assemblies 610 is positionable selectively into or removable from the pair of openings 660 in the forward portion 200*b* of the thrust frame 200. Preferably, each of the pair of openings 660 is defined by a relatively short tubular, such as square tubular box 662, having open upper and lower ends and internal dimensions adapted to receive a lower portion of the outer leg of one of the trailer-leg sub-assemblies 610, as shown in more detail in FIGS. 7-8. The internal length of the box 662 is sufficient to maintain the trailer-leg sub-assemblies 610 in a substantially perpendicular orientation relative to the length of the thrust frame 200.

Continuing to refer to FIGS. 7-8, a connecting sub-assembly 670 is provided for selectively pinning the removable trailer-leg sub-assemblies 610 into the pair of openings 660, whereby the trailer-leg assembly 600 can be inserted selectively into the openings 660 and locked into place or selectively unlocked and removed from the openings 660. The connecting sub-assembly 670 comprises a pair of ears 672 with pin openings therein on each of the pair of telescoping leg sub-assemblies 610. As shown in FIG. 7, a pair of slots 674 is in the forward and rearward portions of the box 662 and adapted to receive at least a portion of the pair of ears 672. A pair of ears 676 with pin openings therein is adjacent to each of the pair of openings 660 on the forward portion 200*b* of the thrust frame 200. Accordingly, as best shown in FIG. 8, when the lower ends of each of the outer legs 612 of the pair of telescoping trailer-leg sub-assemblies 610 are positioned through the openings 660 and the pin openings of the ears 672 and 676 are aligned, a pin 680 can be positioned selectively through each set of the corresponding pin openings of the ears 672 and 676 to lock the pair of trailer-leg sub-assemblies 610 into position. The pins 680 also can be removed selectively to unlock the telescoping trailer-leg sub-assemblies 610 from the thrust frame 200.

Similarly, the brace 627 has a pin opening at a lower end thereof. An ear 786 on the forward portion 200*b* of the thrust frame 200 has a corresponding pin opening there. Accordingly, when the lower end of the brace 627 is positioned adjacent the ear and the pin openings of the two are aligned, a pin 688 can be positioned selectively through the corresponding pin openings to lock the brace 627 to the thrust frame 200. The pin 688 also can be removed selectively to unlock the brace 627 from the thrust frame 200.

Forward Tie-Down Assembly

Referring back to FIGS. 3-5, the apparatus 100 preferably further comprises a tie-down assembly 700 at a forward portion 200*a* of the thrust frame 200. The tie-down assembly 700 comprises a structural member 710 that is connected rigidly to or a part of the forward portion 200*a* of the thrust frame 200. The tie-down assembly 700 also includes a front sand shoe 720 to help position and anchor the forward portion of the thrust frame on the ground G, wherein the front sand shoe 720 is removable from the forward portion of the thrust frame, whereby the front sand shoe can be removed to not interfere with a connection to a tractor 10, as shown in FIGS. 1-2.

As shown in FIGS. 3-5, the structural member 710 is preferably in the form of a tubular member, wherein the bottom portion 711 of the tubular structural member 710 extends along the front end of the forward portion 200*a* of the thrust frame 200. As best shown in the top plan view of FIG. 2, the structural member 710 preferably extends laterally outward to either side of the forward portion 200*a* of the thrust frame 200. The outward extending portions 712 of the structural member 710 provide for tying the structural member 710 to the front sand shoe 720.

Continuing to refer primarily to FIGS. 3-5, the front sand shoe 720 includes a trough 721 in a structural body 723 adapted to receive the bottom portion 711 of the structural member 710. The trough 721 preferably has an inwardly-curved semi-circular shape as shown that is adapted to receive the outwardly-curved semi-circular bottom portion 711 of the structural member 710. The corresponding inwardly-curved semi-circular shape of the trough 721 and the outwardly-curved semi-circular shape of the bottom potion 711 of the structural member 710 allow for some relative rotational movement along the axis of the semi-circular shapes, whereby the angle of the thrust frame 200 has some flexibility relative to the front sand shoe 720. This allows for flexibility of the angle of the thrust frame 200 supported on the front sand shoe 720 during set-up or take-down of the apparatus 100, and flexibility for the angle of attack of the thrust frame 200 to be adjusted for drilling operations.

The structural body 723 of the front sand shoe 720 also includes a flat, bottom surface 722 adapted to distribute the weight of the forward portion 200*a* of the thrust frame 200 on the ground G. The surface area of the flat, bottom surface 722 is much larger than the bottom portion 711 of the structural member 710. The front sand shoe 720 helps support the forward portion 200*a* of the thrust frame 200 on the ground G and helps to prevent it from sinking into the ground, especially when the carriage 300 is moved forward onto the forward portion 200*a* of the thrust frame 200 during drilling operations.

The front sand shoe 720 preferably has a selectively removable retaining clamp 730 on each side. The pair of clamps 730 is adapted selectively to retain the outward extending portions 712 of the structural member 710 in position on the front sand shoe, whereby the forward portion 200*a* of the thrust frame 200 is retained on the front sand shoe 720. The clamps 730 preferably have a semi-circular inner surface 732, whereby the angle of the thrust frame 200 has some flexibility relative to the front sand shoe 720. This allows for flexibility of the angle of the thrust frame 200 supported on the front sand shoe 720 during set-up or take-down of the apparatus 100, and flexibility for the angle of attack of the thrust frame 200 to be adjusted for drilling operations.

Each end 736 of each of the clamps 730 has a pin opening. Each side of the structural body 723 also has a pair of ears 738. Accordingly, when the ends 736 of a clamp 730 are positioned adjacent the pair of ears 738 and the pin openings of the two are aligned, pins can be positioned selectively through the corresponding pin openings to secure the clamp 730 over an outwardly-extending portion 712 of structural member 710. The pins can also be removed selectively to release the outwardly-extending portion 712 from the front sand shoe 720.

Rear Jack Assembly

Referring now primarily to FIGS. 9-10, the apparatus 100 preferably includes a rear jack assembly 800 that can be connected operatively between: (i) a rearward portion 200*b* of the thrust frame 200; and (ii) the ground G adjacent the rearward portion 200*b* of the thrust frame 200. The rear jack assembly 800 is capable of assisting in lifting or lowering the rearward portion 200*b* of the thrust frame between: (a) a lowered position where the rearward portion of the thrust frame is in a lowered position supported on the wheel truck, as best shown in FIG. 1 and FIG. 9; and (b) a raised position where the rearward portion of the thrust frame is in a raised position that is higher than the lowered position, as best shown in FIG. 5 and FIG. 10.

Preferably, the rear jack assembly 800 includes a hydraulic cylinder 810. More preferably, the rear jack assembly 800 is a pair of hydraulic cylinders 810. Having a pair of hydraulic cylinders 810 balanced to either side of a centerline of the thrust frame 200 helps the balancing of the rearward portion 200*b* of the thrust frame as it is being jacked upward or lowered by the pair of hydraulic cylinders 810.

The rear jack assembly 800 preferably is carried by the wheel truck 400. For example, a lower pair of ears 820 is attached to the wheel truck 400 for each of the hydraulic cylinders 810 to which a lower end of each of the hydraulic cylinders 810 can be pinned as shown, and similar to the pinned attachments described above. The rearward portion 200*b* of the thrust frame 200 has an upper pair of ears 830 for each of the hydraulic cylinders 810 to which an upper end of each of the hydraulic cylinders 810 can be pinned as shown, and similar to the pinned attachments described above.

The purpose of the pinned connections for the rear jack assembly 800 is to allow some relative pivotal motion as the rear jack assembly lifts or lowers the rearward portion 200*b* of the thrust frame 200. Another purpose of the pinned connections is to allow for ease of removal of the hydraulic cylinders 810 for maintenance or replacement. Each of the hydraulic cylinders 810 of the rear jack assembly 800 preferably is pinned into position with dowel pins 840. Each of the dowel pins 840 preferably has a handle 842, which is for ease of grasping to insert or remove the pin from the connection.

The hydraulic cylinders 810 are adapted to be connected to an external hydraulic power source, which is typically transported along with the apparatus 100 on a separate semi-trailer (not shown). The hydraulic power to the hydraulic cylinders 810 is controlled with a hydraulic controller 850. Hydraulic lines (not shown) are provided from an external hydraulic power source to the hydraulic controller 850 and to the hydraulic cylinders 810.

The rear jack assembly 800 can be locked into a particular position to support the rearward end 200*b* of the thrust frame 200, for example, hydraulically locked in the case of a hydraulic cylinder. In addition or alternatively to locking the rear jack assembly 800, a bracing assembly 900 including a rearward leg sub-assembly 910 preferably is included as hereinafter described in detail to at least help support the height of the rearward end 200*b* of the thrust frame 200 in a desired raised position for drilling operations.

Bracing Assembly

Referring to FIG. 2 and FIG. 5, the apparatus 100 preferably further includes a bracing assembly 900, wherein the bracing assembly includes: (A) a rearward leg sub-assembly 910 that can be connected operatively and selectively between: (i) the rearward portion 200*b* of the thrust frame 200; and (ii) the ground G adjacent to the rearward portion 200*b* of the thrust frame, wherein the rearward leg sub-assembly 910 is capable of assisting in supporting the rearward portion 200*b* of the thrust frame in the raised position, in FIG. 5 and FIG. 10; and (B) a strut sub-assembly 960 that can be connected operatively and selectively between: (i) a forward portion 200*a* of the thrust frame 200; and (ii) a lower portion of the rearward leg sub-assembly. When the rearward portion 200*b* of the thrust frame 200 is in the raised position, the thrust frame 200, the rearward leg sub-assembly 910, and the strut sub-assembly 960 can be set and locked into a rigid, substantially triangular structural arrangement to stabilize the apparatus 100 for drilling operations.

Preferably, the wheel truck 400 is operatively connected between the lower portion of the rearward leg sub-assembly 910 and the strut sub-assembly 960, for example, as shown in FIG. 5.

Rearward Leg Sub-Assembly of Bracing Assembly

The rearward leg sub-assembly 910 preferably is independent of the rear jack assembly 800. The rearward leg sub-assembly 910 preferably is carried by the wheel truck 400.

In the preferred embodiment of the inventions, the length of the rearward leg sub-assembly 910 can be adjusted, whereby the height of the rearward portion 200*b* of the thrust frame 200 can be selected to help control the angle of attack of the thrust frame 200 relative to the ground G for drilling operations. More particularly, the rearward leg sub-assembly 910 preferably includes a telescoping leg member. For example, the telescoping leg member preferably includes:

(A) an outer leg member 912 and inner leg member 914, wherein the inner leg member 914 is adapted to slide at least partially within the outer leg member 912; (B) a plurality of pin holes 916 (only one of which is shown in FIGS. 9-10) in at least one of the outer leg member 912 and the inner leg member 914 and spaced apart along at least a portion of the axial length of the leg member, for example, in the inner leg member 912; and (C) a pin 918 adapted for the pin holes of the telescoping leg member. The pin 918 of the telescoping leg member can be positioned in one of the plurality of pin holes 916 to hold the telescoping leg members at a desired length. Preferably, each of the pin holes 916 extends entirely through the leg member. Preferably, the rearward leg sub-assembly 910 includes a pair of such telescoping leg members, as shown in the figures.

The rearward leg sub-assembly 910 preferably is carried by the wheel truck 400. For example, a lower pair of ears 920 is attached to the wheel truck 400 for each of the inner leg members 914. A lower end of each of the inner leg members 914 can be pinned to the pair of ears 920 as shown in the figures and similar to the pinned attachments described above. The rearward portion 200*b* of the thrust frame 200 has an upper pair of ears 930 for each of the outer leg members 912 to which an upper end of each of the outer leg members 912 can be pinned as shown in FIG. 10 when in the erected position, and similar to the pinned attachments described above.

The purpose of the pinned connections for the rearward leg sub-assembly 910 is to allow some relative pivotal motion as the rear jack assembly 800 lifts or lowers the rearward portion 200*b* of the thrust frame 200 or to allow for some difference in pivotal position depending on the desired height of the rearward portion 200*b* of the thrust frame. Another purpose of the pinned connections is to allow for ease of removal of the rearward leg sub-assembly 910 for maintenance or replacement. Each end of each of the telescoping leg members (each comprising, for example, the inner leg member 912 and the outer leg member 914) of the rearward leg sub-assembly 910 preferably is pinned with a dowel pin 940. Each of the dowel pins 940 has a handle 942, which is for ease of grasping to insert or remove the pin from the connection.

The length of each of the telescoping leg members (each comprising, for example, the inner leg member 914 and the outer leg member 912) can be adjusted as desired by positioning the pin 918 in the appropriate pin hole 916 of the inner leg member 914. The pin 918 can prevent the telescoping leg members from telescoping further together by stopping the downward movement of the lower edge of the outer leg member 912.

Alternatively, as can be appreciated, the outer leg member 912 can have a similar plurality of pin holes (not shown) as the plurality of pin holes 916 of the inner leg member 914. One of the pin holes in the outer leg member 912 can be aligned with one of the pin holes 916 of the inner leg member 914. A pin 918 can be positioned through the aligned pin holes in the outer leg member 912 and the inner leg member 914 to prevent the telescoping inner and outer leg members from telescoping relative to each other in either direction.

When the rearward portion 200*b* of the thrust frame 200 is to be lowered back onto the wheel truck 400, the upper end of each of the outer leg members 912 is unpinned from the upper pair of ears 930 on the rearward end 200*b* of the thrust frame 200. The telescoping leg members can be laid backwards temporarily about the pivotal pinned connection to the lower pair of ears 920. The hydraulic jacks 810 are used to assume the full weight of the rearward end of the thrust frame 200*b* and then are able to be used to lower the rearward end 200*b* of the thrust frame 200 back downward and onto the wheel truck 400.

After the rearward end 200*b* of the thrust frame 200 is positioned in the lowered position onto the wheel truck 400, the upper end of each of the outer leg members 912 can be raised back up to a substantially vertical position and strapped to the rearward portion 200*b* of the thrust frame 200. More particularly, for example, the upper end of each of the outer leg members 912 can be strapped into a receiving trough 950 and retained in the receiving trough 950 by a strap 952. When strapped in this position, the rearward leg sub-assembly 910 is secured for transport of the apparatus. The receiving trough 950 and the strap 952 can have a similar design as in the tie-down assembly 700, as described above, except for being in a substantially vertical position.

Strut Sub-Assembly of Bracing Assembly

Referring now primarily to FIGS. 1, 3-5, and 11, the strut sub-assembly 960 preferably is carried by the wheel truck 400. In the preferred embodiment of the inventions, the length of the strut sub-assembly 960 can be adjusted, whereby the height of the rearward portion 200*b* of the thrust frame 200 can be selected to help control the angle of attack of the thrust frame 200 relative to the ground G for drilling operations. More particularly, the strut sub-assembly 960 preferably includes a telescoping strut member. For example, the telescoping strut member preferably includes: (A) an outer strut member 962 and inner strut member 964, wherein the inner strut member 964 is adapted to slide at least partially within the outer strut member 962; (B) a plurality of pin holes 966 in at least one of the outer strut member 962 and the inner strut member 964, the plurality of pin holes 966 spaced apart along at least a portion of the length of the strut member; and (C) a pin 968 adapted for the pin holes of the telescoping strut member. The pin 968 for the telescoping strut member can be positioned in one of the plurality of pin holes 966 to hold the telescoping strut members at a desired length. Preferably, each of the pin holes 966 extends entirely through the strut member. Preferably, the strut sub-assembly 960 includes a pair of such telescoping strut members, as shown in the figures.

The strut sub-assembly 960 preferably is carried by the wheel truck 400. For example, a lower pair of ears 963 is attached to the wheel truck 400 for each of the outer strut members 962. As shown in FIG. 11, a lower end of each of the outer strut members 962 can be pinned to the pair of ears 963 as shown in the figures and similar to the pinned attachments described above. As best shown in FIG. 5, for example, the underside of the forward portion 200*a* of the thrust frame 200 has an upper pair of ears 965 for each of the inner strut members 964 to which an upper end of each of the inner strut members 964 can be pinned when in the erected position, and similar to the pinned attachment shown for the outer strut members 962 as shown in FIG. 11.

The purpose of the pinned connections for the strut sub-assembly 960 is to allow some relative pivotal motion as the rear jack assembly 800 lifts or lowers the rearward portion 200*b* of the thrust frame 200 or to allow for some difference in pivotal position depending on the desired height of the rearward portion 200*b* of the thrust frame. Another purpose of the pinned connections is to allow for ease of removal of the strut sub-assembly 960 for maintenance or replacement. Each end of each of the telescoping strut members (each comprising, for example, the outer leg member 962 and the inner leg member 964) of the strut sub-assembly 960 preferably is pinned with a dowel pin 940. Each of the dowel pins 940 has a handle 942, which is for ease of grasping to insert or remove the pin from the connection.

The length of each of the telescoping strut members (each further including, for example, the outer strut member 962 and the inner leg member 964) can be adjusted as desired by aligning one of the pin holes in the outer leg member 962 with one of the pin holes of the inner strut member 964. A pin 918 can be positioned through the aligned pin holes in the outer strut member 962 and in the inner strut member 964 to prevent the telescoping inner and outer strut members from telescoping relative to each other in either direction.

Outriggers for Wheel Truck

Referring primarily to FIGS. 9-10, the apparatus 100 preferably includes a pair of outriggers 970 capable of assisting in laterally stabilizing the apparatus in a drilling position. The outriggers 970 are preferably part of the bracing assembly 900. One of the outriggers 970 is positioned on either side of the apparatus 100. Each of the outriggers 970 preferably includes a telescoping horizontal leg 972 adapted for laterally extending or retracting of the outrigger and a telescoping vertical leg 974 with a sand shoe 976 adapted for planting on the ground G adjacent to either side of the apparatus 100. Each sand shoe 976 preferably is connected to the lower end of telescoping vertical leg 974 at a pivotal connection 977. When deployed, the pair of outriggers 970 take at least some of the weight of the apparatus off the wheels 406 of the wheel truck 400 and assist in bracing the apparatus laterally.

As best shown in FIGS. 9-10, each of the outriggers 970 preferably includes a jack 982 operatively connected for laterally deploying or retracting each of the telescoping horizontal legs 972 from the wheel truck 400; and preferably further includes a jack 984 operatively connected for vertically deploying or retracting the telescoping vertical leg 974 and the sand shoe 976 on each of the outriggers. Most preferably, each of the jack 982 for laterally deploying or retracting, and the jack 984 for vertically deploying or retracting, includes a hydraulic cylinder, as shown in the Figures. Each of the hydraulic cylinders for the jacks 982 and 984 is connected operatively to valve controller 983 and 985, respectively, one for each of the outriggers. Accordingly, the outriggers 970 can be locked hydraulically into a deployed position with the grounding of a sand shoe 976 to either side of the apparatus 100 as shown in FIG. 10 or a retracted position supported by the wheel truck 400 for movement of the apparatus as shown in FIG. 9.

According to a preferred embodiment of the inventions, the jack 800 is connected operatively between the wheel truck 400 and the rearward portion 200*b* of the thrust frame 200. The outriggers 970 stabilize and ground the frame of the wheel truck 400.

Methods of Take Down, Operation, and Set-Up of Apparatus

In general, to prepare the apparatus 100 for transportation involves most or all of the following steps, which may be performed in any practical sequence. Securing the carriage 300 in a middle portion of the thrust frame 200 to balance the load during transport; disconnecting and storing hydraulic hoses and mud lines; disconnecting the pins 918 and 968 from bracing assembly 900; lowering the rearward portion 200*b* of the thrust frame 200 onto the wheel truck 400; attaching the trailer-leg assembly 600 to the forward portion 200*a* of the thrust frame 200; disconnecting the front sand shoe 720 from the structural member 710 on the forward portion 200*a* of the thrust frame 200; jacking up the forward portion 200*a* of the thrust frame; connecting the king pin 500 of the apparatus to a fifth wheel 22 of a road tractor 10.

For transportation, the wrenches are removed from the apparatus and shipped separately because of weight. To move a conventional mud system (not shown) for use with the apparatus 100 involves separate transportation. Moving a hydraulic power plant for the carriage 300 will also involve separate transportation to a drilling site. Further, welders, breakout tooling, augers, reamers, hole openers, and other downhole tools (not shown) used in drilling operations involve separate transportation for those items.

In general, to erect the apparatus 100 after transportation to a drilling site involves most or all of the following steps, which can be performed in any practical sequence. Jacking up the forward portion 200*a* of the thrust frame 200; disconnecting the king pin 500 of the apparatus 100 from the fifth wheel 22 of a road tractor 10; lowering the structural member 710 on the forward portion 200*a* of the thrust frame onto a front sand shoe 720; removing the trailer-leg assembly 600; jacking up the rearward portion 200*b* of the thrust frame 200 to a raised position; pinning the bracing assembly 900 to lock the apparatus 100 rigidly with the thrust frame supported in an inclined position for drilling operations; connecting hydraulic hoses and mud lines to the apparatus.

The invention also includes the step of using the apparatus 100 for drilling operations. The apparatus 100 preferably includes a fixed wrench (not shown), which is a hydraulic clamp for holding adjacent sections of drill pipe during making the joints for adding to the drill string D, and a breakout wrench (also not shown), which is a movable wrench that applies force to loosen a joint between sections of drill pipe of the drill string D. As shown in FIG. 6, a cutting head or auger A is advanced by sections of drill pipe that are added to the drill string D as drilling progresses. A conventional hydraulic power plant (not shown) is used to drive the carriage 300.

During drilling, soil and rock are removed with the assistance of a lubricating fluid injected through the drill string D and into the bore. The lubricating fluid is typically a mixture of water, bentonite clay, and other substances depending on soil conditions. The lubricating fluid is known as a "drilling fluid" or "drilling mud." A conventional mud system (not shown) for use with the apparatus 100 is used to make up the drilling fluid. The drilling fluid is pumped through the drill string and forces a jet of the drilling fluid out of each of the one or more orifices in the cutting head or auger A. The mud is circulated through the annulus of the bore and returns to the surface entrance of the bore, carrying soil and cuttings to the surface.

The operator controls the rotation of the drill string D, the advancement and pullback of the carriage, flow and volume of drilling fluid, and the fixed wrench and the breakout wrench. It may be necessary or desirable to enlarge the pilot bore with a reamer. Hard rock may require additional special cutting heads. The desired entry angle for drilling is determined by the length and depth of the bore taking into account the allowable bending of the sections of drill pipe and the joints making up the drill string D.

After careful consideration of the specific and exemplary embodiments of the inventions described herein, a person of ordinary skill in the art will appreciate that certain modifications, substitutions and other changes can be made without substantially deviating from the principles of the inventions. The detailed description is illustrative, the spirit and scope of the inventions being limited only by the appended claims.

What is claimed is:

1. An apparatus for horizontal drilling, the apparatus comprising:

(A) a thrust frame;

(B) a carriage having a spindle for drilling operations, wherein the carriage is positioned to move forward and backward along the thrust frame;

(C) a wheel truck, wherein a rearward portion of the thrust frame can be supported in a lowered position on the wheel truck; and (D) a king pin for operatively connecting a forward portion of the thrust frame to a tractor without operatively connecting through the wheel truck or rearward portion of the thrust frame;

(E) a trailer-leg assembly that can be connected operatively between:

(i) the forward portion of the thrust frame and (ii) the ground adjacent to the forward portion of the thrust frame without being connected operatively through the rearward portion of the thrust frame; and wherein the trailer-leg assembly is capable of assisting in supporting the forward portion of the thrust frame:

(a) in a raised position off the ground so that a connector of a tractor can be moved into or out of position under the forward portion of the thrust frame, whereby the tractor can be removed from or connected to the forward portion of the thrust frame for towing; and (b) in a lowered position where the forward portion of the thrust frame is in a lowered position adjacent the ground, whereby the forward portion of the thrust frame can be lowered to assist positioning the thrust frame in an inclined position for horizontal drilling operations.

2. The apparatus according to claim 1, wherein the trailer-leg assembly is removable from the thrust frame so that the trailer-leg assembly is not operatively connected to the thrust frame.

3. The apparatus according to claim 1, further comprising a jack for the trailer-leg assembly, whereby the apparatus can be connected to or removed from a tractor without a separate machine for lifting or lowering the forward portion of the thrust frame.

4. The apparatus according to claim 3, wherein the jack is a hydraulic cylinder.

5. The apparatus according to claim 4, further comprising a hydraulic motor for the jack for the trailer-leg assembly.

6. The apparatus according to claim 5, wherein the trailer-leg assembly, the hydraulic cylinder, and the hydraulic motor is an assembly that can be removed selectively from and connected to the forward portion of the thrust frame.

7. The apparatus according to claim 1, further comprising: a front sand shoe to help position and anchor the forward portion of the thrust frame on the ground, wherein the front sand shoe is removable from the forward portion of the thrust frame, whereby the front sand shoe can be removed to not interfere with a connection to a tractor.

8. The apparatus according to claim 1, further comprising:

a jack assembly that can be connected operatively between:

(i) a rearward portion of the thrust frame and (ii) the ground adjacent the rearward portion of the thrust frame without being connected through the forward portion of the thrust frame;

wherein the jack assembly is capable of assisting in lifting or lowering the rearward portion of the thrust frame between:

(a) a lowered position where the rearward portion of the thrust frame is in a lowered position supported on the wheel truck; and (b) a raised position where the rearward portion of the thrust frame is in a raised position that is higher than the lowered position.

9. The apparatus according to claim 1, further comprising a bracing assembly, wherein the bracing assembly comprises:

(A) a rearward leg sub-assembly that can be connected operatively and selectively between:

(i) the rearward portion of the thrust frame and (ii) the ground adjacent to the rearward portion of the thrust frame without being operatively connected through the forward portion of the thrust frame, wherein the rearward leg sub-assembly is capable of assisting in supporting the rearward portion of the thrust frame in the raised position; and (B) a strut sub-assembly that can be connected operatively and selectively between:

(i) a forward portion of the thrust frame; and (ii) a lower portion of the rearward leg sub-assembly;

whereby, when the rearward portion of the thrust frame is the raised position, the thrust frame, the rearward leg sub-assembly, and the strut sub-assembly can be set and locked into a rigid, substantially triangular structural arrangement to stabilize the apparatus for drilling operations.

10. The apparatus according to claim 9, wherein the wheel truck is connected operatively between the lower portion of the rearward leg sub-assembly and the strut sub-assembly.

11. An apparatus for horizontal drilling, the apparatus comprising:

(A) a thrust frame;

(B) a carriage having a spindle for drilling operations, wherein the carriage is positioned to move forward and backward along the thrust frame;

(C) a wheel truck, wherein a rearward portion of the thrust frame can be supported in a lowered position on the wheel truck;

(D) a king pin operatively for connecting a forward portion of the thrust frame to a tractor without operatively connecting through the wheel truck or the rearward portion of the thrust frame;

(E) a rear jack assembly that can be connected operatively between:

(i) a rearward portion of the thrust frame and (ii) the ground adjacent the rearward portion of the thrust frame without being operatively connected through the forward portion of the thrust frame;

wherein the rear jack assembly is capable of assisting in lifting or lowering the rearward portion of the thrust frame between:

(a) a lowered position where the rearward portion of the thrust frame is in a lowered position supported on the wheel truck; and (b) a raised position where the rearward portion of the thrust frame is in a raised position that is higher than the lowered position.

12. The apparatus according to claim 11, further comprising a bracing assembly, wherein the bracing assembly comprises:

(A) a rearward leg sub-assembly that can be connected operatively and selectively between:

(i) the rearward portion of the thrust frame and (ii) the ground adjacent to the rearward portion of the thrust frame without being operatively connected through the forward portion of the thrust frame, wherein the rearward leg sub-assembly is capable of assisting in supporting the rearward portion of the thrust frame in the raised position; and (B) a strut sub-assembly that can be connected operatively and selectively between:

(i) a forward portion of the thrust frame and (ii) a lower portion of the rearward leg sub-assembly without being operatively connected through the rearward portion of the thrust frame when the strut sub-assembly is at least partially bracing between the forward portion of the thrust frame and the lower portion of the rearward leg sub-assembly when in the raised position; whereby the thrust frame, the rearward leg sub-assembly, and the strut sub-assembly can be set and locked into a rigid, substantially triangular structural arrangement to stabilize the apparatus for drilling operations.

13. The apparatus according to claim 12, wherein the wheel truck is connected operatively between the lower portion of the rearward leg sub-assembly and the strut sub-assembly without being operatively connected through the forward portion of the thrust frame.

14. The apparatus according to claim 12, wherein the strut sub-assembly is carried by the wheel truck.

15. The apparatus according to claim 12, wherein the length of the strut sub-assembly can be adjusted.

16. The apparatus according to claim 15, wherein the strut sub-assembly comprises a telescoping strut member.

17. The apparatus according to claim 11, further comprising a trailer-leg assembly that can be connected operatively between:

(i) the forward portion of the thrust frame and (ii) the ground adjacent to the forward portion of the thrust frame without being operatively connected through the rearward portion of the thrust frame; and wherein the trailer-leg assembly is capable of assisting in supporting the forward portion of the thrust frame:

(a) in a raised position off the ground so that a connector of a tractor can be moved into or out of position under the forward portion of the thrust frame, whereby the tractor can be removed from or connected to the forward portion of the thrust frame for towing; and (b) in a lowered position where the forward portion of the thrust frame is in a lowered position adjacent the ground, whereby the forward portion of the thrust frame can be lowered to assist positioning the thrust frame in an inclined position for horizontal drilling operations.

18. The apparatus according to claim 17, wherein the trailer-leg assembly is removable from the thrust frame.

19. The apparatus according to claim 17, further comprising a jack for the trailer-leg assembly, whereby the apparatus can be connected to or removed from a tractor without a separate machine for lifting or lowering the forward portion of the thrust frame.

20. The apparatus according to claim 19, wherein the jack is a hydraulic cylinder.

21. The apparatus according to claim 20, further comprising a hydraulic motor for the jack for the trailer-leg assembly.

22. The apparatus according to claim 21, wherein the trailer-leg assembly, the hydraulic cylinder, and the hydraulic motor is an assembly that can be removed selectively from and connected to the forward portion of the thrust frame.

23. The apparatus according to claim 17, further comprising: a front sand shoe to help position and anchor the forward portion of the thrust frame on the ground, wherein the front sand shoe is removable from the forward portion of the thrust frame, whereby the front sand shoe can be removed to not interfere with a connection to a tractor.

24. The apparatus according to claim 11, wherein the rear jack assembly comprises a hydraulic cylinder.

25. The apparatus according to claim 11, wherein the rear jack assembly is carried by the wheel truck.

26. The apparatus according to claim 11, wherein the rearward leg sub-assembly is independent of the rear jack assembly.

27. The apparatus according to claim 11, wherein the rearward leg sub-assembly is carried by the wheel truck.

28. The apparatus according to claim 11, wherein the length of the rearward leg sub-assembly can be adjusted.

29. The apparatus according to claim 28, wherein the rearward leg sub-assembly comprises a telescoping leg member.

30. The apparatus according to claim 11, wherein the wheel truck further comprises a pair of outriggers capable of extending laterally and grounding a sand shoe to either side of the apparatus.

31. The apparatus according to claim 30, wherein the pair of outriggers take at least some of the weight of the apparatus off the wheels of the wheel truck.

32. The apparatus according to claim 30, wherein the rear jack assembly is connected operatively between the wheel truck and the rearward portion of the thrust frame without being operatively connected through the forward portion of the thrust frame.

33. The apparatus according to claim 30, further comprising a lateral jack for laterally deploying or retracting each of the outriggers from the wheel truck; and further comprising a vertical leg jack for vertically deploying or retracting a sand shoe on each of the outriggers.

34. The apparatus according to claim 33, wherein the lateral jack for laterally deploying or retracting and the vertical jack for vertically deploying or retracting each comprises a hydraulic cylinder.

35. The apparatus according to claim 11, wherein the outriggers can be hydraulically locked into a deployed position with the grounding of a sand shoe to either side of the apparatus or a retracted position supported by the wheel truck.

* * * * *